US007676925B2

(12) United States Patent
Kawaguchi et al.

(10) Patent No.: US 7,676,925 B2
(45) Date of Patent: Mar. 16, 2010

(54) LIFTING CONSTRUCTION METHOD AND RAISING/LOWERING EQUIPMENT OF BOILER MODULE

(75) Inventors: Shigeyoshi Kawaguchi, Chiyoda-ku (JP); Kazuhito Nakamitsu, Chiyoda-ku (JP); Yuuichi Hayashi, Chiyoda-ku (JP)

(73) Assignee: Hitachi Plant Engineering & Construction Co., Ltd., Tokyo (JP)

( * ) Notice: Subject to any disclaimer, the term of this patent is extended or adjusted under 35 U.S.C. 154(b) by 858 days.

(21) Appl. No.: 11/293,116

(22) Filed: Dec. 5, 2005

(65) Prior Publication Data

US 2007/0074397 A1 Apr. 5, 2007

(30) Foreign Application Priority Data

Sep. 30, 2005 (JP) ..... 2005-287053

(51) Int. Cl.
*B21D 51/24* (2006.01)
*F41A 9/00* (2006.01)

(52) U.S. Cl. ..... 29/890.051; 29/709; 414/589; 414/591

(58) Field of Classification Search ..... 29/890.05, 29/890.051, 890.03, 897, 428, 726, 709; 414/589, 591; 212/270
See application file for complete search history.

(56) References Cited

U.S. PATENT DOCUMENTS 3,703,849 A * 11/1972 Renner et al. ..... 91/509
3,880,293 A * 4/1975 Ahlgren ..... 212/328
6,041,491 A * 3/2000 Ishikawa et al. ..... 29/709

FOREIGN PATENT DOCUMENTS

| | | | | |
|---|---|---|---|---|
| CA | 992023 | * | 6/1976 | ..... 201/135.3 |
| JP | A-49-94052 | | 9/1974 | |
| JP | A-51-4758 | | 1/1976 | |
| JP | A-62-22904 | | 1/1987 | |
| JP | 09278385 A | * | 10/1997 | |
| JP | 2000234311 A | * | 8/2000 | |
| JP | A 2000-329306 | | 11/2000 | |
| JP | A 2003-252577 | | 9/2003 | |
| JP | 2005022771 A | * | 1/2005 | |
| JP | 2005060966 A | * | 3/2005 | |

* cited by examiner

*Primary Examiner*—David P Bryant
*Assistant Examiner*—Ryan J Walters
(74) *Attorney, Agent, or Firm*—Oliff & Berridge, PLC

(57) ABSTRACT

An interference with existing structures is prevented at a time of a lifting construction of a boiler module. When the boiler module is lifted from the ground by lifting jacks provided on a steel frame main-beam and made an install construction to the main-beam, lifting jacks enabled to move laterally on the main-beam are disposed at forward and backward thereof to suspend the boiler module. The suspended module is lifted up to the main-beam and installed while changing a suspending position between an interference preventing position with existing modules and a prescribed suspending position by alternately moving the forward and backward lifting jacks laterally.

4 Claims, 7 Drawing Sheets

LIFTING CONSTRUCTION METHOD AND RAISING/LOWERING EQUIPMENT OF BOILER MODULE

BACKGROUND OF THE INVENTION

1. Field of the Invention

The present invention relates to a lifting construction method and a raising/lowering equipment of a boiler module, and particularly relates to the lifting construction method and the raising/lowering equipment of the boiler module suitable for use when the boiler module at a thermal power station is lifted to a steel frame main-beam and made an install construction.

2. Description of Related Art

In a thermal power station having large suspending type boilers, a main-beam for supporting boilers is provided at a top end portion of a steel frame to be a suspending fabric, and boiler components are supported in a state suspended to this main-beam. For this building, a lifting construction method is generally adopted, plural lifting jacks provided on the main-beam are used, a module being a boiler component carried inside of the steel frame is lifted from the ground under dozens of meters to the main-beam by using the lifting jacks, and it is suspended and supported by the main-beam by using sling rods and so on. Such works are performed repeatedly from the module to be assembled to an upper portion of the boiler to the module to be assembled to a lower portion of the boiler sequentially to thereby build a boiler facility. Attendant equipments are assembled to the boiler module at a ground work or in a middle of a lifting operation. That is to say, the assembling work of the attendant equipments is often performed in a state that the boiler module is supported by a temporary beam provided at the ground side, or suspended by the lifting jack.

By the way, as the lifting jack used for the raising/lowering work of the boiler module, a step rod type jack having a constitution that a suspending rod is inserted into the jack is used. The above-stated suspending rod has a constitution in which single short rods are coupled by screwing each other in an axial direction to be elongated. A structure of the single rod is the one that a head portion with a slightly large-diameter is formed at an upper end portion of a rod portion, a female screw portion is formed at a top surface of the head portion, a male screw portion is formed at a lower end of a shaft portion, and a piece of long suspending rod is formed by continuously coupling respective single rods in a screwed coupling. A jack up is enabled by using the head portion of the single rod. A plurality of lifting jacks using such suspending rods are provided on the main-beam in a high place position at a top portion of the steel frame of a power station building, and hang the above-stated suspending rods to suspend and raise/lower the boiler module.

However, at an installation field of the boiler and so on of the power station, when both the boiler module to be lifted up and the existing modules to be coupled to are existing, an interference may occur such as a contact with the existing modules at the time of raising/lowering work, because a coupling thereof is enabled under a lift completion state. Besides, there is a case when an obstacle such as a temporary fixture may exist on a raising/lowering excursion. Under such an environment, it has been significantly difficult for the lifting construction method using the step rod type lifting jack having only an operation characteristics in a vertical direction, to perform the raising/lowering work while avoiding the interference with the existing modules or the obstacles.

Considering the above, an art in which the boiler module is enabled to rotate at a lower end of the suspending rod to avoid the obstacles and so on as an object thereof (Patent Document 1), and the one having a structure that a lower portion of the suspending rod is changed to a wire so as to move in a horizontal direction by a wire portion to retreat temporary (Patent Document 2) are proposed.

[Patent Document 1] Japanese Patent Application Laid-open No. 2000-329306

[Patent Document 2] Japanese Patent Application Laid-open No. 2003-252577

SUMMARY OF THE INVENTION

However, in a technical means described in the above-stated Patent Document 1, a fixture to rotate the suspended boiler module and a crane facility constitution for rotation are necessary, and there was a problem of less than desirable operation. Besides, in an example described in the latter Patent Document 2, a horizontal force actions to the suspending rod, and it may cause to bend the perpendicular rod. If the suspending rod inclines over a predetermined angle, it becomes a safety hazard.

The present invention has an eye on the above-stated conventional problems, and the object thereof is to realize a safety lifting construction method while surely preventing the interference with the existing structures.

To achieve the above-stated object, a lifting construction method of a boiler module according to the present invention, in which the boiler module is lifted from the ground by lifting jacks provided on a steel frame main-beam and made an install construction to the main-beam, the lifting construction method of the boiler module including: suspending the boiler module by disposing the lifting jacks enabled to move laterally on the main-beam at forward and backward of the boiler module; and lifting and installing the suspended module to the main-beam while changing a suspending position between a position preventing an interference with existing modules and a prescribed suspending position by laterally moving the forward and backward lifting jacks alternately.

Besides, in the lifting construction method of the boiler module, the forward and backward lifting jacks are moved laterally while alternately making stepped by moving with a constant pitch by using short stroke lateral traveling jacks in a state that a spacer is arranged between the forward and backward lifting jacks in a lateral traveling direction to keep a minimum spacing.

Further, the lateral traveling jacks, provided to make the forward and backward lifting jacks in the lateral traveling direction travel laterally, are set interchanged between forward and backward of the respective lifting jacks to enabling a shift of the lateral traveling direction. A lateral moving pitch of the lifting jack can be set to be within an allowed inclining angle of a suspending rod being suspended.

A raising/lowering equipment of a boiler module according to the present invention, which is used for a construction to lift the boiler module from the ground by lifting jacks provided on a steel frame main-beam, and to install to the main-beam, including: lifting jacks lines arranged at forward and backward in a rail direction by laying a lateral moving guide rail on the main-beam; lateral traveling jacks with a short stroke alternately making the forward and backward lifting jacks lines travel laterally to thereby enable lateral stepwise movement of the lifting jacks and enabling lateral moves thereof, and wherein a suspending position of the suspended boiler module is made changeable between an interference preventing position with existing modules and a prescribed suspending position.

In this case, driving hydraulic equipments of lateral traveling jacks group of front line lifting jacks and lateral traveling jacks group of rear line lifting jacks in lateral traveling direction are independent.

According to the above-stated constitution, in the present invention, an attaching work of attendant equipments can be performed by a ground work while at first lifting the boiler module to be lifted at a prescribed position. After this work is completed, the process is transferred to a lifting work for installation to the steel frame main-beam, but the lifting objective boiler module cannot have a free space when it is lifted at the prescribed position to be coupled to the existing boiler module. Conventionally, a tensile move and so on is performed by a crane wire and so on, so that the lifting objective boiler module may not be interference with the existing module. However, in the present invention, when the boiler module is lifted to an interference position, the lifting jack suspending the module on the main-beam in itself can be moved laterally on the main-beam. This lateral move is an alternate stepping move in which forward lifting jacks in a moving direction are moved with a constant pitch, and then backward lifting jacks are similarly moved with the constant pitch to follow. Interval between the forward and backward lifting jacks are kept with a spacer, and therefore, the interval between the forward and backward suspending rods is prevented from becoming too short, and a swing may not become large. It is moved with a constant pitch by a lateral traveling jack with a short stroke, and therefore, an inclination range of the suspending rod is limited, and a trouble in jacking up caused by an excessive inclination, or a risk of a breakage at a coupling portion of rods can be avoided. The forward and backward lifting jacks can be moved in lateral direction, and therefore, an interference such as a crash with the existing module at the time of lifting can be prevented from occurring. After the lifting is completed, the suspending position is placed back to a prescribed position by laterally moving in a backward direction, and therefore, a coupling work between modules can also performed without trouble.

DETAILED DESCRIPTION OF THE PREFERRED EMBODIMENTS

Hereinafter, a concrete embodiment of a lifting construction method and a raising/lowering equipment of a boiler module according to the present invention will be explained in detail with reference to the drawings.

Figure 1:
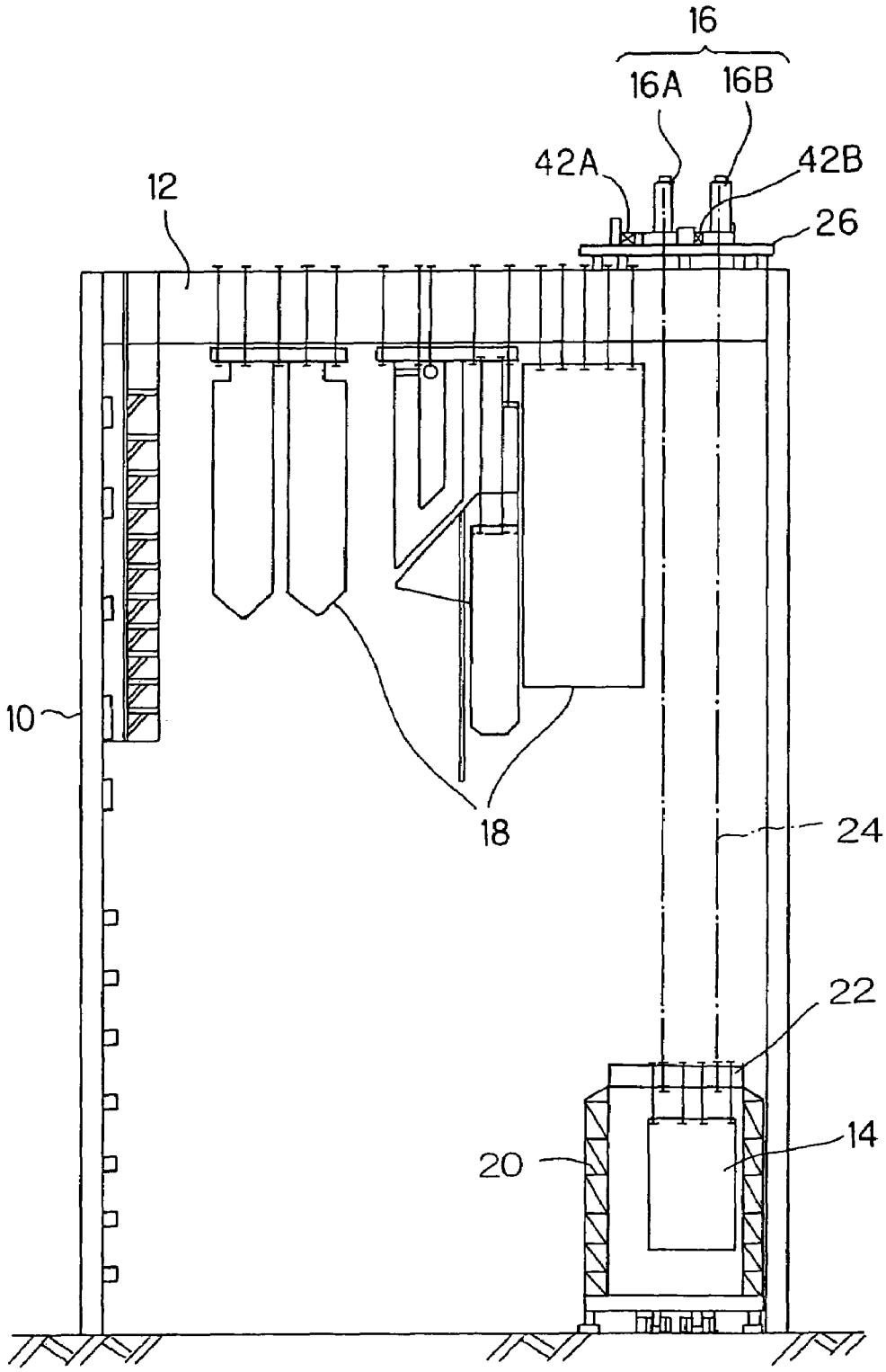
FIG. 1 is an explanatory view showing a lifting construction state of a boiler module.

FIG. 1 is an explanatory view showing a lifting construction state of the boiler module. A lifting objective boiler module 14 is lifted up from the ground to make an install construction by lifting jacks 16 to a main-beam 12 provided at a top portion of a steel frame 10 of a power station. In an example shown in the drawing, a state in which a superheater bank coil module (lifting objective boiler module 14) is to be lifting constructed after boiler modules (existing boiler modules 18) such as a second superheater, a third superheater, or a reheater are installed to the main-beam 12.

The lifting objective boiler module 14 is carried inside of the steel frame 10 by a moving jack stand 20. This boiler module 14 is carried in by a ground move in a state hanging from a temporary beam 22. Meanwhile, suspending rods 24 are suspended from the lifting jacks 16 provided on the main-beam 12, and they are coupled to the above-stated temporary beam 22. The lifting jacks 16 are set to lift the boiler module 14 by before boiler lifting jacks 16A composed of ten jacks group arranged at near side of a furnace (not shown) and after boiler lifting jacks 16B also composed of ten jacks group arranged at far side of the furnace. Consequently, the boiler module 14 is lifted up together with the temporary beam 22 by a total of 20 suspending rods 24 composed of 10 forward rods and 10 backward rods.

The lifting objective boiler module 14 is lifted from immediately under an installation position to the main-beam 12, but when it is lifted at the assembling position to the main-beam 12, there is a possibility that an interference may occur with the adjacent existing boiler module 18 because there is no space. Consequently, in this embodiment, the above-stated lifting jacks 16 (16A, 16B) are made laterally movable on the main-beam 12, and the before boiler and after boiler lifting jacks 16A, 16B disposed forward and backward along a lateral moving direction are alternately made stepping move, lift the boiler module 14 at the position not to be interference with the existing boiler modules 18, and it is position adjusted to a prescribed suspending position by laterally moving in a backward direction after the lifting work is completed. Of course when an obstacle and so on other than the existing boiler modules 18 exist during the lifting process, it is possible to laterally move the lifting jacks 16 so as to avoid the obstacle.

Figure 2:
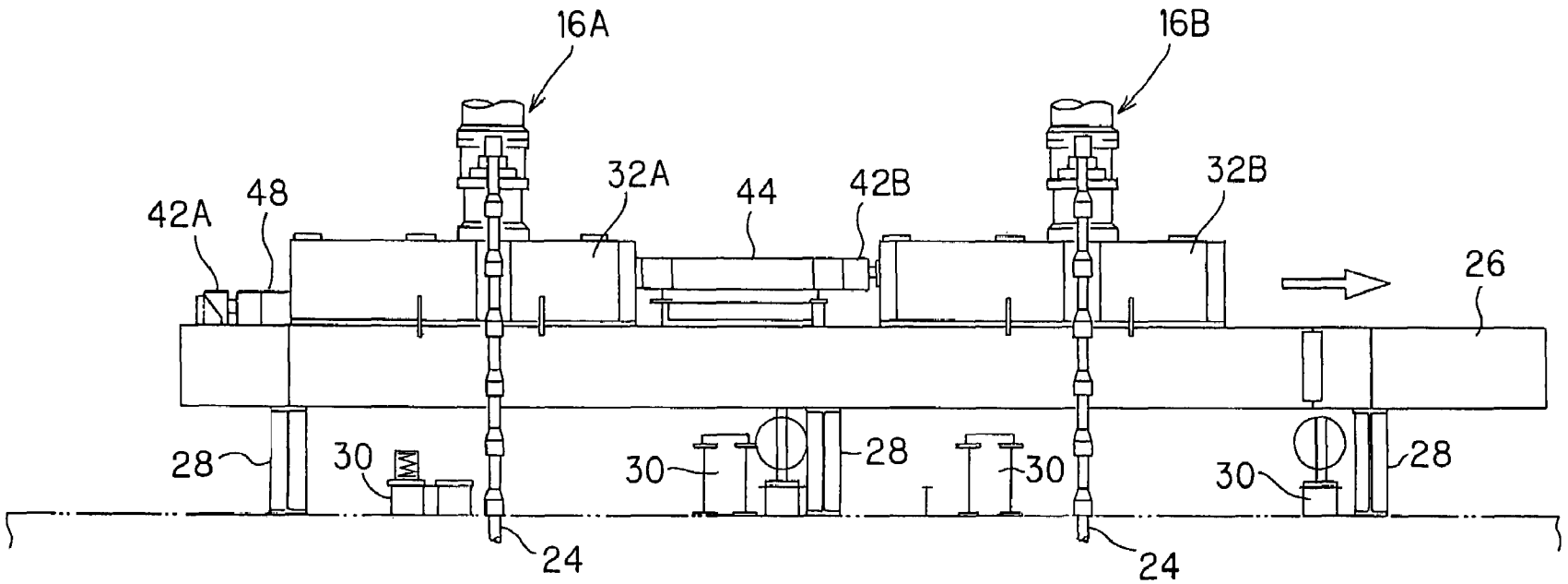
FIG. 2 is a side view of a boiler module raising/lowering equipment including a lateral moving mechanism.
Figure 3:
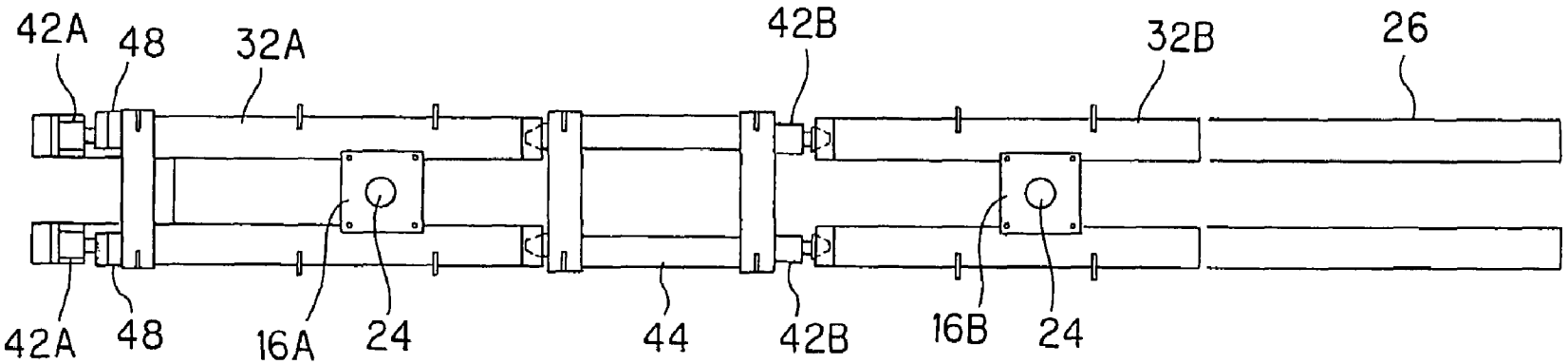
FIG. 3 is a plan view of the boiler module raising/lowering equipment including the lateral moving mechanism.

A detail of a boiler module raising/lowering equipment including such a lateral moving mechanism of the lifting jacks 16 is shown in FIG. 2 to FIG. 3. FIG. 2 is a side view and FIG. 3 is a plan view thereof. These views show a forward boiler lifting jack 16A and a backward boiler lifting jack 16B arranged in a single line. However, such jack line may be provided for ten lines. A lateral guide rail 26 in parallel is fixed on the main-beam 12. This lateral guide rail 26 is disposed at a constant height position via supporting legs 28 to avoid sling rod supporting portions 30 on the main-beam 12. Moving bases 32A, 32B mounting the lifting jacks 16A, 16B are respectively placed movably along the lateral guide rail 26 so that they are movable on the lateral guide rail 26. The lifting jacks 16 mounted on the moving bases 32 (32A, 32B) are hanging the suspending rods 24 between the rails of the lateral guide rail 26.

Figure 4:
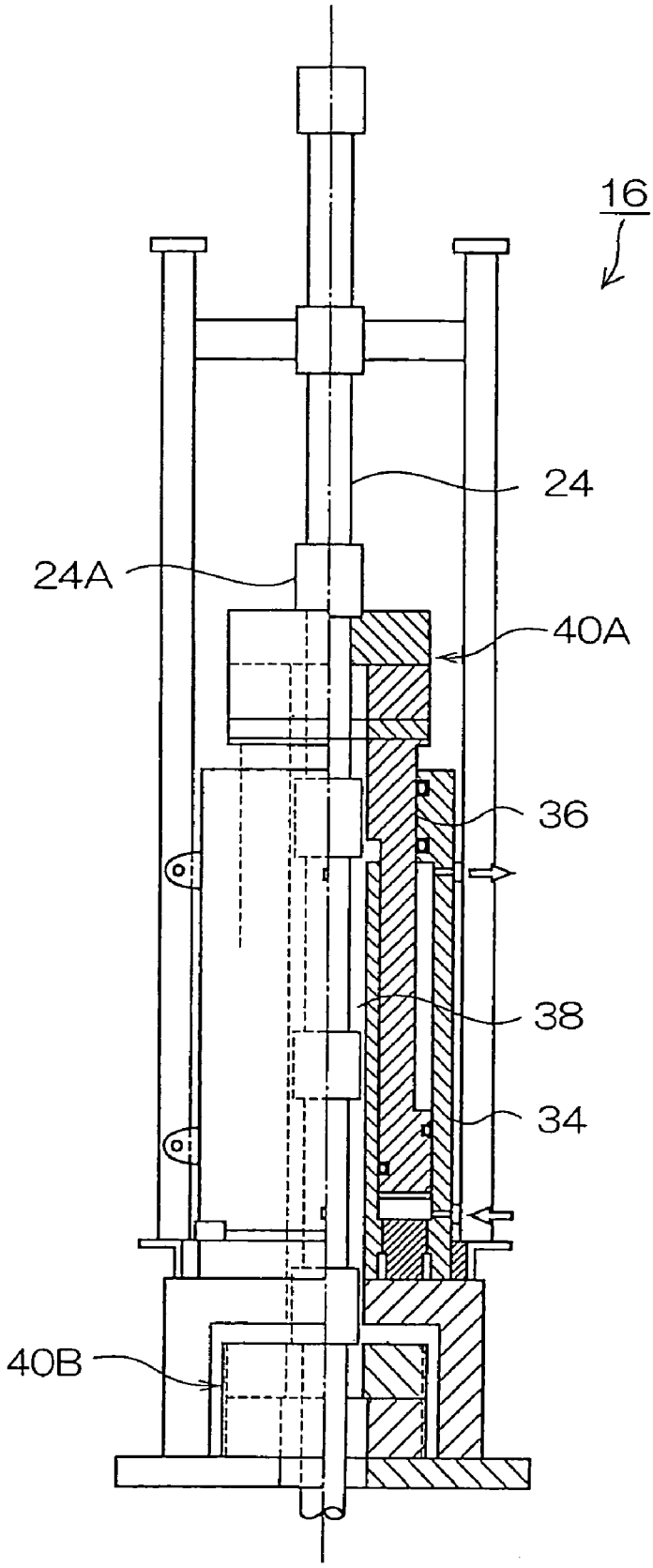
FIG. 4 is a partial sectional view of a lifting jack.

Here, a configuration of the lifting jack 16 is briefly described by using FIG. 4. The lifting jack 16 is composed of a cylinder 34 being a fixed outer cylindrical member and a slider 36 inserted into the cylinder 34. The cylinder 34 has a double-wall structure, and accommodates the slider 36 from an opening of an upper portion of a hydraulic chamber formed inside of a wall member, to thereby enable a raising/lowering of the slider 36. At a center portion of such jack 16, a center hole 38 is formed, and chuck units 40 (40A, 40B) are provided at both end portions of the center hole 38. The jack 16 is operated by a not shown hydraulic pump, and a stroke of the slider 36 and a chuck opening/closing of the chuck units 40 are controlled. The suspending rod 24 is penetrated into the center hole 38, and a rod head portion 24A is gripped when the chuck units 40 are closed. Namely, the suspending rod 24 is raised and lowered by controlling the opening/closing of the upper and lower chuck units 40A, 40B, and performing a stroke control of the slider 36 while gripping the suspending rod 24.

The moving bases 32 mounting such lifting jacks 16 move along the lateral guide rail 26, to thereby change the position of the lifting boiler module 14. However, the lifting jack 16 is a mechanism to raise and lower the suspending rod 24 in a vertical direction, and it is suspended from a high place at dozens of meters upward from the ground, so it is impossible to simply perform a lateral move because it is dangerous if the suspending rod 24 inclines or the like.

Consequently, in the raising/lowering equipment according to the present embodiment, the above-stated lifting jacks 16A, 16B are made laterally movable by stepwise movement with a short stroke by lateral traveling jacks 42A, 42B. In the embodiment, the stroke of the lateral traveling jacks 42A, 42B are set to be 100 mm, and this is to keep a maximum inclination angle of the suspending rod 24 at a time of maximum jack stroke to be within one degree being a safety angle.

Besides, the lateral traveling jacks 42A, 42B are respectively disposed to press rear portions of the moving bases 32A, 32B in the moving direction. In a state that a spacer 44 is arranged between the moving bases 32A, 32B of the forward and backward lifting jacks 16A, 16B in the lateral traveling direction to keep a minimum spacing, the respective forward and backward lifting jacks 16A, 16B are laterally moved while alternately making stepped stepwise movement with a constant pitch by the lateral traveling jacks 42A, 42B. The suspending rods 24 of the before boiler and after boiler lifting jacks 16A, 16B are coupled to the temporary beam 22 of the lifting objective boiler module 14, and the space between the lifting jacks 16A, 16B is kept to correspond to this coupling space also at the main-beam 12 side. The spacer 44 between jacks is disposed so that this space is to be the minimum space. However, the lateral traveling jack 42B making the after boiler lifting jack 16B move laterally is disposed at a front end portion of the spacer 44 (rear portion of the after boiler moving base 32B), and therefore, a spacer size is defined so that the space including the size of this lateral traveling jack 42B corresponds to the prescribed suspending rod space. The lateral traveling jack 42A at before boiler side is attached to a jack supporting bracket 46 fixed to the lateral guide rail 26 to press the before boiler moving base 32A. A liner 48 is interposed between the before boiler moving base 32A to fill in the space created by every lateral move. As the liner 48, the one having a size of 100 mm corresponding to the stroke of the lateral traveling jack 42 and the one having a thinner size to fill in a fraction are to be prepared.

Figure 5:
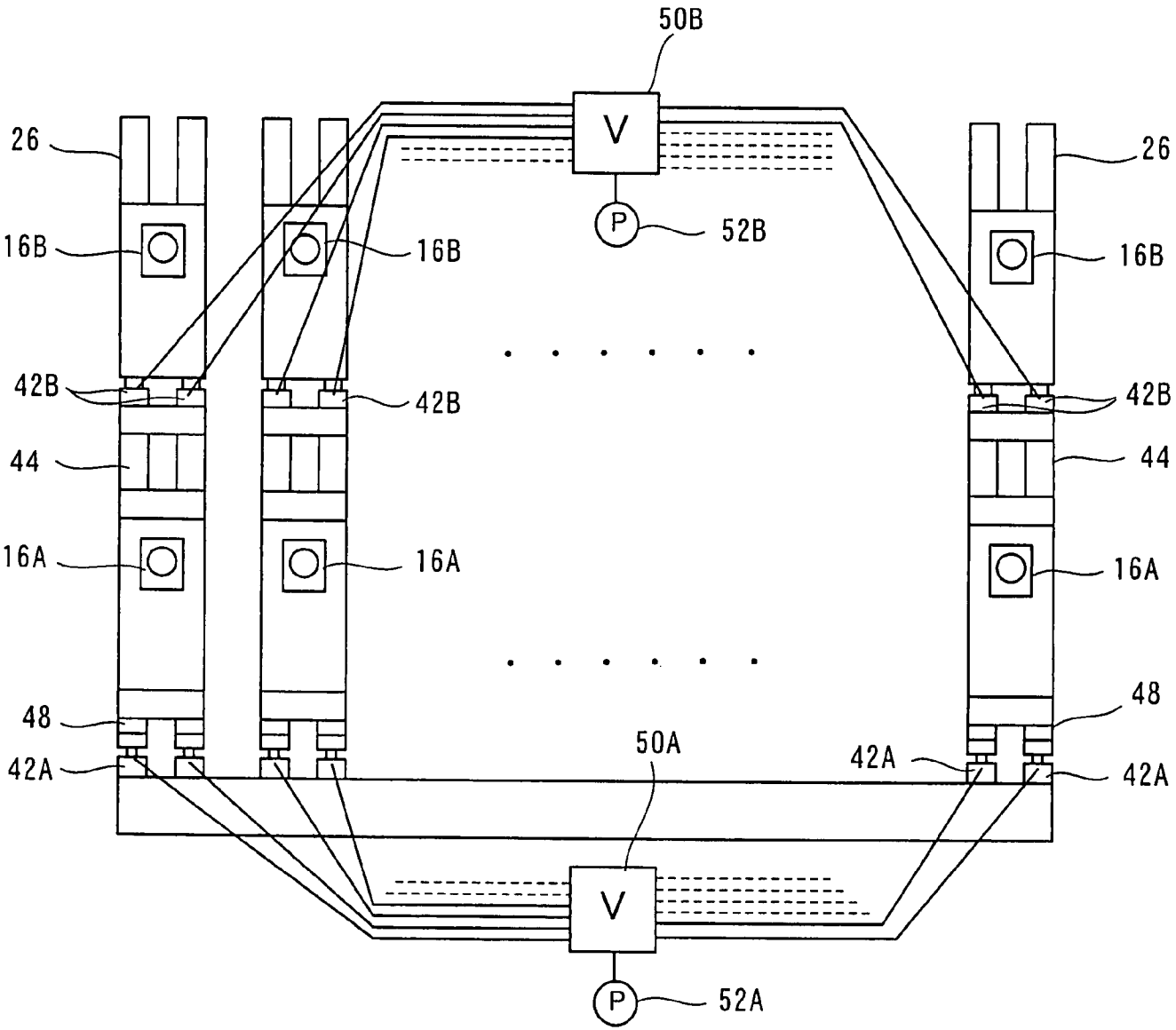
FIG. 5 is a hydraulic system chart of the boiler module raising/lowering equipment.

Incidentally, two lateral traveling jacks 42 are required for one lifting jack 16, and therefore, twenty lateral traveling jacks 42 are respectively used for before boiler and after boiler lifting jacks in the raising/lowering equipment of the embodiment. In the present invention, driving hydraulic equipments of the lateral traveling jacks 42B group for the after boiler lifting jacks 16B positioned at a front line in the lateral traveling direction and the lateral traveling jacks 42A group of the before boiler lifting jack 16A positioned at a rear line are driven independently. This hydraulic system chart is shown in FIG. 5. The twenty lateral traveling jacks 42A at before boiler side are driven by a hydraulic unit composed of a valve equipment 50A and a hydraulic pump 52A, and independent from this, the twenty lateral traveling jacks 42B at after boiler side are driven by a hydraulic unit composed of a valve equipment 50B and a hydraulic pump 52B. Herewith, it is possible to avoid an influence on the suspended boiler module 14 such as a rolling caused by a problem of the hydraulic system because they are separated between the before boiler and after boiler at the time of the lateral move.

Figure 6:
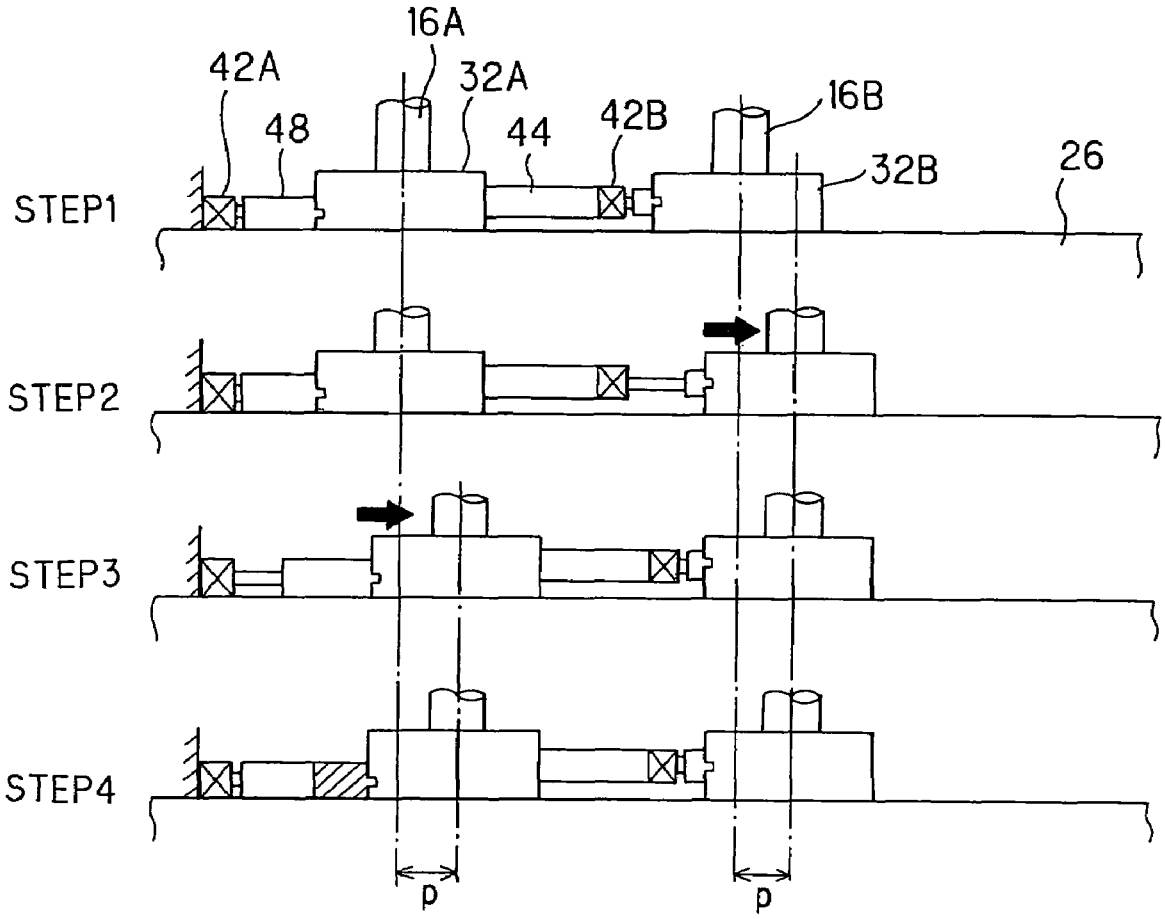
FIG. 6 is an explanatory view of a stepping lateral move of the lifting jack.

A stepping operation of the raising/lowering equipment of the boiler jack constituted as stated above, is described with reference to FIG. 6, which is schematically shown for easy to understand. In step 1, initial states of the lifting jacks 16 of before boiler and after boiler are shown. By an instruction of start of the lateral move, the lateral traveling jack 42B pushes the after boiler lifting jacks 16B by an actuation of the forward hydraulic pump 52B in the lateral moving direction, namely after boiler side, and a hydraulic supplying operation by the valve equipment 50B, and it advances the lifting jacks 16B for the stroke. Herewith, the ten after boiler lifting jacks 16B are laterally moved for one pitch (100 mm) (step 2). After that, the hydraulic pressure to the lateral traveling jack 42B pushing the after boiler lifting jacks 16B is opened to a tank side by operating the valve equipment 50B. Next, the before boiler lifting jacks 16A is advanced for the stroke of the lateral traveling jack 42A by the actuation of the backward hydraulic pump 52A in the lateral moving direction, namely at the before boiler side, and the hydraulic supplying operation of the valve equipment 50A. Herewith, the ten before boiler lifting jacks 16A are moved for one pitch (100 mm) (step 3). At this time, the lateral traveling jack 42B pushing the after boiler side shrinks automatically because a hydraulic passage is opened to the tank. A rod pulling operation of the lateral traveling jack 42A at the before boiler side which is just pushed is performed, and thereby, a space for a moved pitches is created, and the liner 48 is interposed here to complete one moving process (step 4). After that, by repeating the step 2 to the step 4, the before boiler and after boiler lifting jacks 16A, 16B can move laterally while alternately making stepwise movement by one pitch. After it moved for a predetermined distance, the position of the before boiler lateral traveling jack 42A is interchanged, and thereafter the lateral move may be proceeded similarly.

As stated above, the before boiler and after boiler lifting jacks 16A, 16B are made stepping move, and thereby, it becomes possible to make a steady raising/lowering operation after the lateral move without adding any offset load to the lifting jacks 16 when the boiler module 14 is lifted while lifting up the suspending rod 24 vertically.

Figure 7:
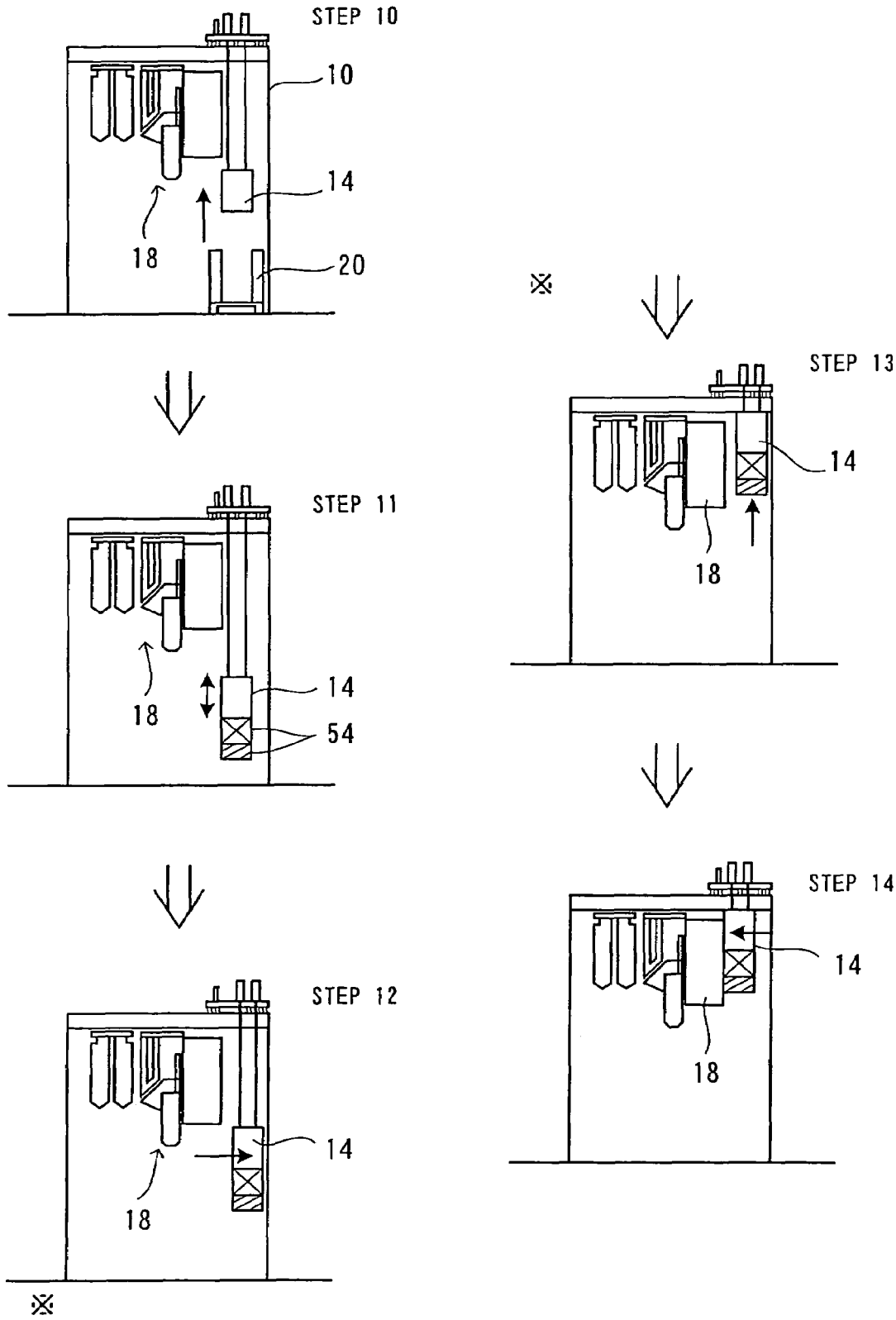
FIG. 7 is an explanatory view of a lifting construction state of the boiler module according to the present embodiment.

FIG. 7 shows a process to perform a lifting construction of the boiler module 14 by using the above-stated raising/lowering equipment. When the boiler module 14 to be lifting constructed is carried in by the moving jack stand 20, it is once lifted upward by the raising/lowering equipment (step 10), and the moving jack stand 20 is moved outside of the steel frame 10. After that, the boiler module 14 is lowered, and equipments 54 attendant on this boiler module 14 are attached by a ground work while sequentially lifting to move (step 11). After attachments of the attendant equipments 54 are completed, the raising/lowering equipment is laterally moved (step 12). The process of the lateral move is as it is described with reference to FIG. 6. Herewith, it becomes possible to prevent the lifting objective boiler module 14 from occurring an interference such as a crash with the existing boiler modules 18, especially with adjacent modules. As shown in step 13, after the lifting is performed to the main-beam 12, the raising/lowering equipment is laterally moved in a backward direction (step 14). This backward direction lateral move can be performed by interchanging the lateral traveling jacks 42, provided to laterally move the forward and backward lifting jacks 16 in the lateral traveling direction, between forward and backward of the respective lifting jacks to thereby perform a shift of the lateral traveling direction. Namely, the lateral traveling jack 42A pushing the before boiler lifting jack 16A (moving base 32A) at first is invertedly disposed at a front end side of the after boiler lifting jack 16B and a pressing operation is performed to realize the shift. At this time, the lateral traveling jack 42B existing between the lifting jacks 16A, 16B, is invertedly disposed, but there is no problem if the disposition is as it is because it may work similarly.

As stated above, in the present embodiment, when the boiler module 14 is lifted from the ground by the lifting jacks 16 provided on the steel frame main-beam 12, to perform an install construction to the main-beam 12, the boiler module 14 is suspended by disposing the lifting jacks 16 enabled to move laterally on the main-beam 12 at forward and backward thereof, the forward and backward lifting jacks 16A, 16B are alternately moved laterally, and thereby, the suspended boiler module 14 is lifted and installed to the main-beam 12 while changing the suspending position between an interference preventing position with the existing boiler modules 18 and the prescribed suspending position. Consequently, a safety lifting construction of the boiler module is realized while surely preventing the interference with existing structures.

What is claimed is:

1. A lifting construction method of a boiler module, in which the boiler module is lifted from the ground by suspending rods in a plurality of lifting jacks provided on a steel frame large beam and made to accommodate an install construction to the large beam, said lifting construction method of the boiler module comprising:

suspending the boiler module by disposing the lifting jacks, which are enabled to move laterally on the large beam, at a position forward and a position backward of the boiler module; and lifting and installing the suspended module to the large beam while changing a suspending position between a position preventing an interference with existing modules and a prescribed suspending position by laterally moving the forward and backward lifting jacks alternately with a short stroke defined to limit an inclination range of the suspending rods of the lifting jacks;

wherein the forward and backward lifting jacks are moved laterally in alternating stepwise movement with a constant pitch by using short stroke lateral traveling jacks; wherein a spacer is arranged between the forward and backward lifting jacks to keep a minimum spacing between jacks in a lateral traveling direction.

2. The lifting construction method of the boiler module according to claim 1, wherein the lateral traveling jacks, which are arranged to make the forward and backward lifting jacks travel laterally, are set interchanged at positions forward and backward of the respective lifting jacks to enable a shift in the lateral traveling direction.

3. A raising/lowering equipment for a boiler module, which is used for a construction to lift the boiler module from the ground by suspending rods in a plurality of lifting jacks provided on a steel frame large beam, and to install the module to the large beam, comprising:

a plurality of lifting jack lines comprised of the plurality of lifting jacks arranged at positions forward and backward in a lateral traveling direction about a lateral moving guide rail arranged on the large beam;

a spacer arranged between the forward and backward lifting jacks to maintain a minimum spacing between jacks in the lateral traveling direction, such that the forward and backward lifting jack lines travel laterally in stepwise movement by using lateral traveling jacks, and wherein the lateral traveling jacks have a short stroke constitution which is defined to limit an inclination range of at least one of the suspending rods of at least one of the plurality of lifting jacks, and wherein a suspending position of the suspended boiler module is made changeable between an interference preventing position with existing modules and a prescribed suspending position.

4. A raising/lowering equipment for a boiler module, according to claim 3, wherein the lateral traveling include driving hydraulic equipment, and wherein the driving hydraulic equipment of a front line of lateral traveling jacks and the driving hydraulic equipment of a rear line of lateral traveling jacks are independent.

* * * * *